United States Patent [19]

Klein

[11] 4,209,090

[45] Jun. 24, 1980

[54] DISPLAY PACKAGE

[76] Inventor: Herbert S. Klein, 5 Horizon Rd., Fort Lee, N.J. 07024

[21] Appl. No.: 24,407

[22] Filed: Mar. 27, 1979

[51] Int. Cl.[2] ..... B65D 5/66; B65D 25/14

[52] U.S. Cl. ..... 206/45.28; 220/338; 229/44 R

[58] Field of Search ..... 220/337, 338, 340, 341, 220/342, 339; 229/44 R, 44 M; 206/228, 45.19, 45.28

[56] References Cited

U.S. PATENT DOCUMENTS

| | | | |
|---|---|---|---|
| 2,379,254 | 6/1945 | Rathbun | 220/342 X |
| 3,095,965 | 7/1963 | Stahl et al. | 220/337 X |
| 3,352,478 | 11/1967 | Wood | 229/44 R |
| 3,782,592 | 1/1974 | Bergh et al. | 229/44 M |
| 4,150,779 | 4/1979 | Hilbrands | 229/44 R |

FOREIGN PATENT DOCUMENTS

| | | | |
|---|---|---|---|
| 180854 | 4/1916 | Canada | 220/338 |
| 1129775 | 1/1957 | France | 220/342 |

*Primary Examiner*—Joseph Man-Fu Moy

*Attorney, Agent, or Firm*—Morgan, Finnegan, Pine

[57] ABSTRACT

A display package comprised of a display container section and a hinged cover attached together by a retaining member on the cover and a mating recess in the display container section in which the retaining member is secured. The recess is provided with strategically located overlapping edges and protuberances or undercuts to grip the cover retaining member.

3 Claims, 12 Drawing Figures

Fig. 2.
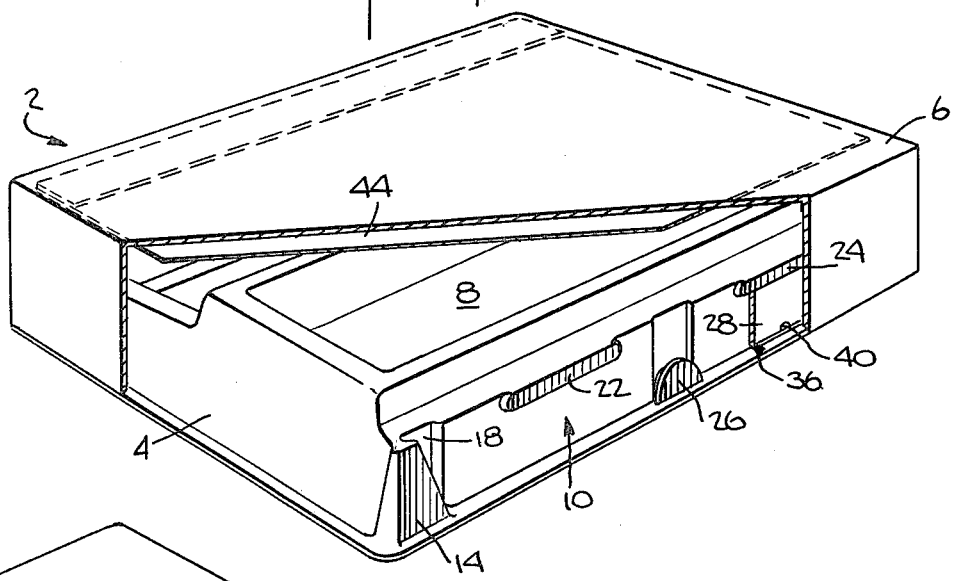
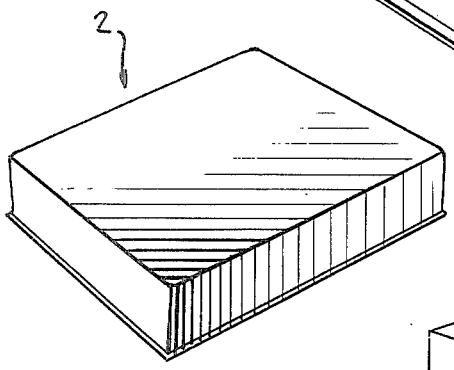
Fig. 1.
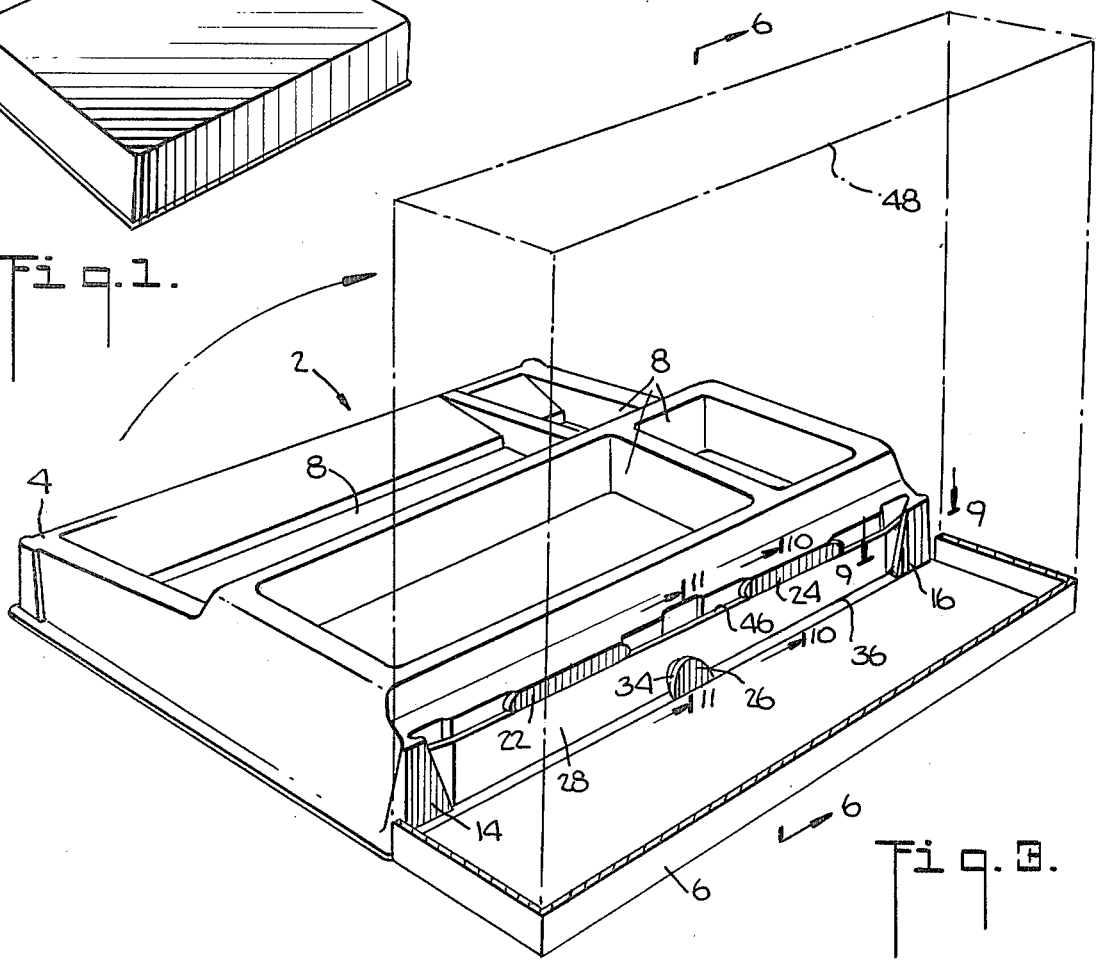
Fig. 3.

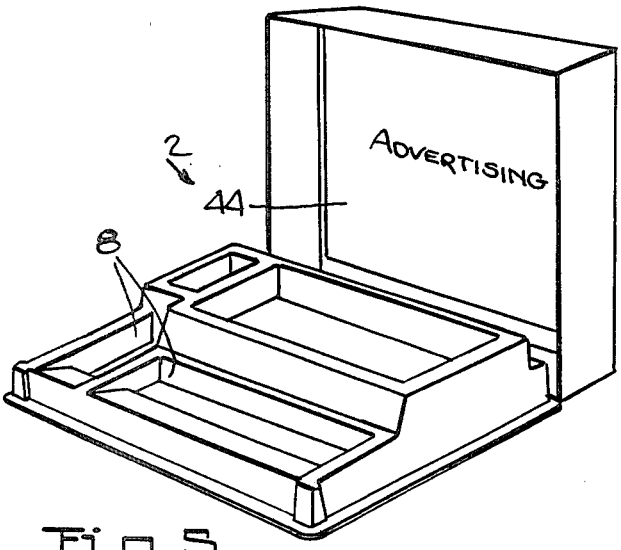
Fig. 3.
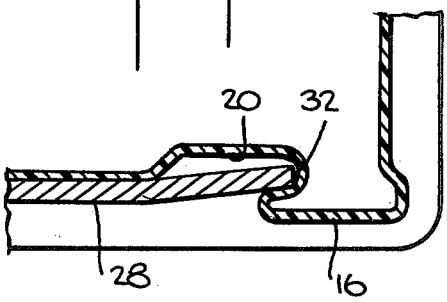
Fig. 5
Fig. 11.
Fig. 10.
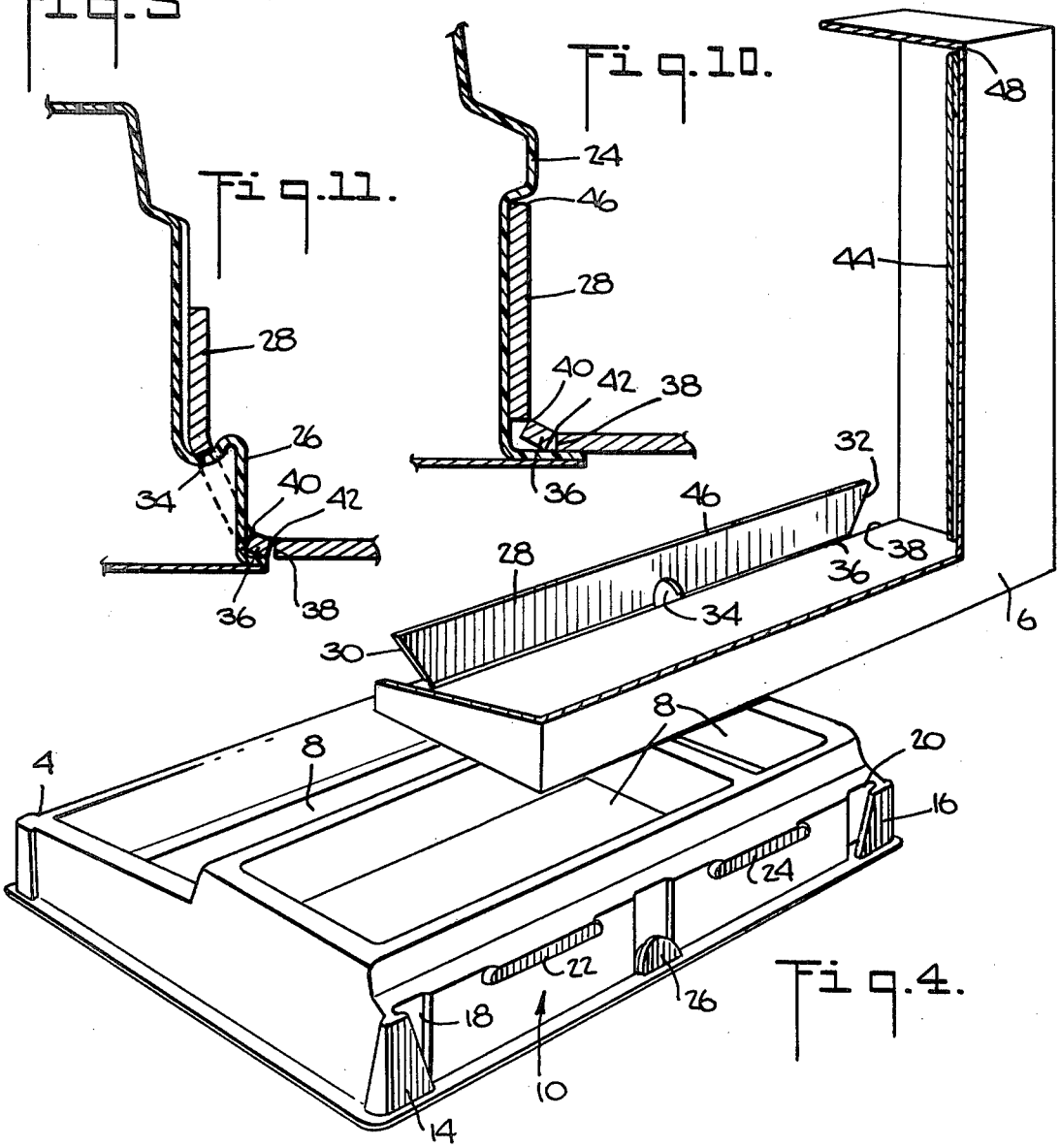
Fig. 4.

DISPLAY PACKAGE

FIELD OF THE INVENTION

The invention relates to two piece packages in which the cover is distinct from the container. More particularly, the invention relates to display packages of two piece construction wherein the container mounts the article for display and the cover, in the upright position, provides a surface for advertising or similar copy.

BACKGROUND OF THE INVENTION

Boxes comprised of a container section and a separate cover section has been known for many years. Similarly, display packages have been popular for displaying various articles such as cameras, binoculars, cosmetics and many other items which are marketably enhanced by attractive display.

Typically, the prior efforts at two-piece packages having a cover releasibly attached to the box are characterized by tabs on the cover member which attach to slots cut into the body of the container section. Another early design is the box cover with a depending attachment member that fits tightly against the back wall of the container and essentially forms a force fit to retain the cover. Illustrative of the prior art two-piece containers are Weiss (U.S. Pat. No. 1,058,929), Schoettle (U.S. Pat. No. 2,003,224) and Warren (U.S. Pat. No. 1,192,359).

SUMMARY OF THE INVENTION

It is an object of the present invention to provide a display package separately formed of a display container and a cover.

It is a further object of the present invention to provide a display container of plastic having an appropriately formed recess to accept a retaining member hingedly mounted to the separate cover.

It is another object of the present invention to provide a container comprised of a display section and a cover section which cover section in the open position is maintained in a stable perpendicular position and which provides a surface for advertising or similar copy.

It is still another object of the invention to provide a package which in the closed mode safely stores the article contained therein and in the open mode forms an attractive display mount.

The display package of the present invention is comprised of a flocked plastic container member having cavities formed therein which cavities are in the contour of the article which the package is adapted to display. The container member also has formed therein, in the back surface, a recess extending essentially the length of the container which recess is provided with overlapping edges on each end and undercuts intermediately disposed along the upper edge. A centrally disposed tab extending upwardly from the bottom of the recess is also contemplated.

The cover which, in the preferred form is cardboard, is provided with a retaining member hingedly attached to the cover. The retaining member is essentially the size of the recess in the container member and is provided with a slot through which the tab extending from the bottom of the recess can fit. A small finite hinge member between the retaining member and the cover edge affords free movement of the cover from the fully closed position to an orientation essentially perpendicular to the box when in the open position.

DESCRIPTION OF THE DRAWINGS

The invention will be better understood when considered with the following drawings wherein:

FIG. 1 is an isometric view of the display package of the present invention in the closed mode;

FIG. 2 is the isometric view of FIG. 1 with a partial cut-away showing the means for attaching the cover;

FIG. 3 is an isometric view of the container section showing the cover attachment inserted in the container attachment recess;

FIG. 4 is an exploded view of the display package showing the recess of the container section and the retaining member of the cover section;

FIG. 5 is an isometric view of the display package in the open position;

FIG. 9 is a sectional view taken through line 9—9 of FIG. 3;

FIG. 10 is a sectional view taken through line 10—10 of FIG. 3;

FIG. 11 is a sectional view taken through line 11—11 of FIG. 3; and

DESCRIPTION OF THE PREFERRED EMBODIMENT

The display package 2 of the present invention is provided to display any of a variety of articles such as cameras, binoculars, cosmetics, medical or electronic equipment, etc. The display package 2 is adapted to attractively display the article accommodated by the package and at the same time provide a cover which in the open position has the additional feature or function of a display surface for advertising or similar copy.

The display package 2 of the present invention shown in FIGS. 1 and 2 in the closed mode is comprised essentially of a container member 4 and a cover 6.

The container member 4 of the display package 2 is molded to afford contour fitting cavities 8 for the article which is being displayed. As illustrated in FIG. 3, essentially four cavities 8 have been formed in the particular display container member 4. Of course, more than or less than four cavities 8 can be formed in the container member 4 depending on the article being displayed. The container member 4 can be made of many different materials. However, vacuum formable plastics such as high impact styrene, polyvinyl chloride and acetates are particularly suitable materials for the container member 4. In the preferred form the display container member is formed of flocked plastic.

Figure 7:
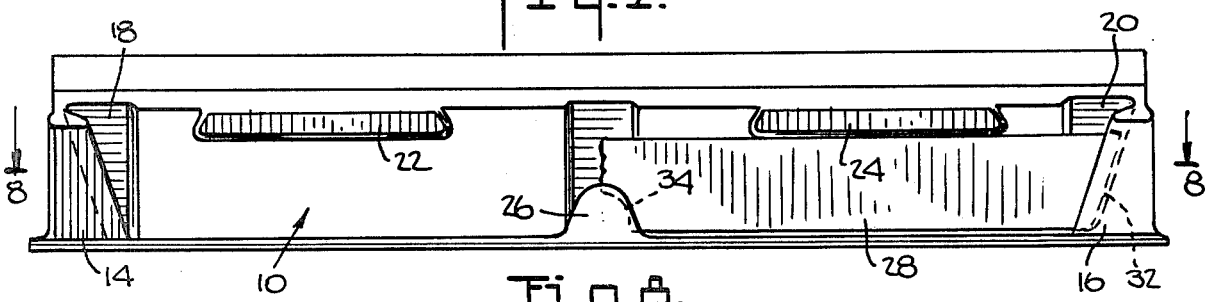
FIG. 7 is a sectional elevational view of the recess of the container section and a partial sectional of the retaining member inserted in the recess.
Figure 8:
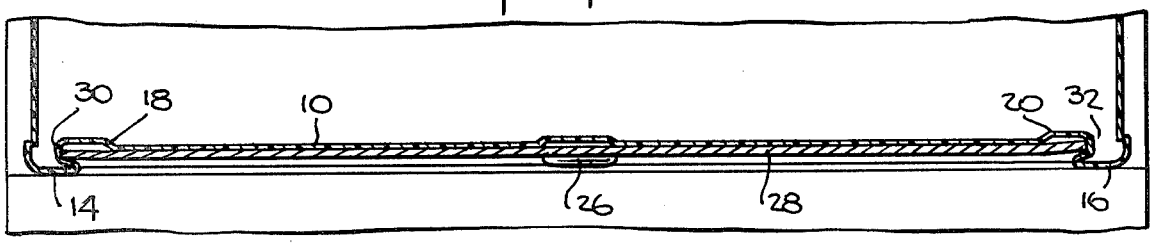
FIG. 8 is a sectional view taken through line 8—8 of FIG. 7.

The display container member 4 is also provided with a recess 10 extending along essentially the entire length of the rear of the container member 4, as best seen in FIGS. 2, 4 and 7. The recess 10 is provided with overlapping edge members 14 and 16 at either end and depressions 18 and 20 immediately below each of the edge members 14 and 16. Protuberances or undercuts 22 and 24 are strategically located along the upper edge of the recess 10. A tab 26 is also provided to extend upwardly from the bottom of the recess 10 at an intermediate position.

Figure 12:
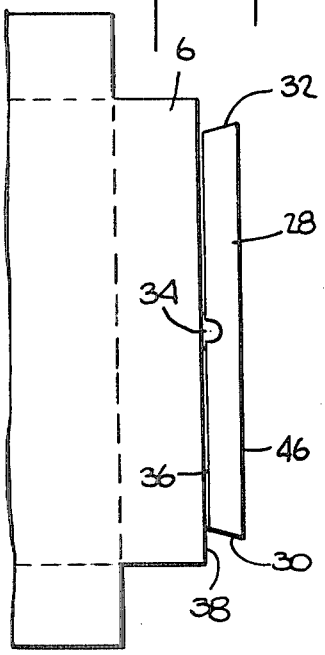
FIG. 12 is a view of the retaining member of the cover and cover shown flattened.

The cover 6 of the present invention is sized to cover the entire display container member 4 and is provided with a retaining member 28, best seen in FIGS. 3, 7 and 12. The retaining member 28 is essentially the length of the recess 10 and is configured to conform to the contour of the recess 10. The retaining member 28 is provided with edges 30 and 32 which are formed on a bias. The edges 30 and 32 thus form an incline which facilitates insertion behind the overlapping edge members 14 and 16 in the rear of the display container member 4. A centrally disposed opening 34 is also provided to cooperate with the tab 26 extending upwardly from the bottom of the recess 10, as seen in FIG. 11. A hinge 36 is provided between the retaining member 28 and the back edge 38 of the cover 6. The hinge 36 extends essentially the length of the retaining member 28. As seen in FIGS. 10 and 11, a score line 40 is formed between the hinge 36 and the retaining member 28 and a second score line 42 is formed between the hinge 36 and the back edge 38 of the cover 6. In practice, it has been found that a cover of cardboard material such as rigid boxboard or folding boxboard is particularly suitable for use as the material for the cover 6.

Figure 6:
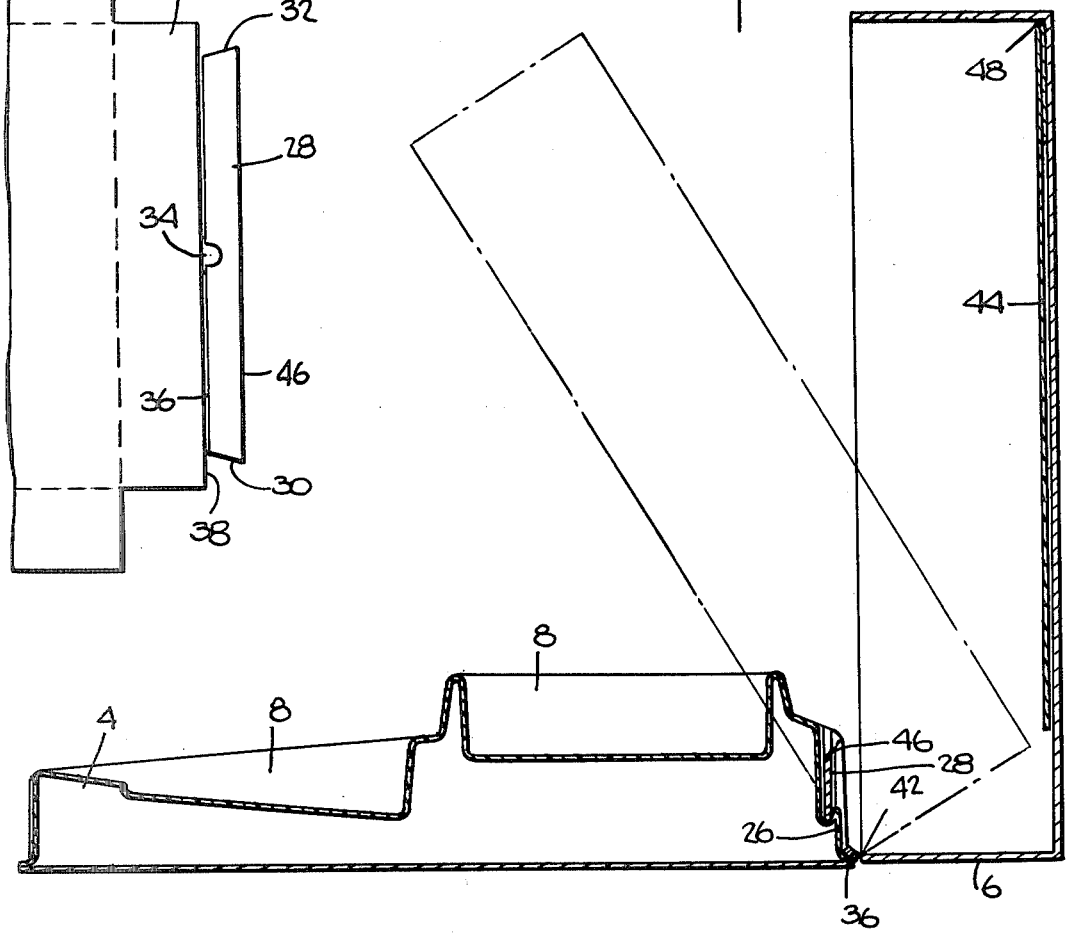
FIG. 6 is a side elevational view taken through line 6—6 of FIG. 3.

A flap 44 which fits within the area of the cover 6 is provided for advertising or similar copy. The flap 44 is secured at one edge to the cover 6 along the top inside edge 48 of the cover as seen in FIG. 6, and can pivot outwardly or nest within the contour of the cover 6.

Assembly of the display package 2 occurs by inserting the inclined edges 30 and 32 of the retaining member 28 into the recess 10 with the inclined edges 30 and 32 under the overlapping edge members 14 and 16 respectively. The depressions 18 and 20 in the recess provide an area into which the inclined edges 30 and 32 can be accommodated by virtue of the force imposed by the location of the overlapping edge members 14 and 16 as illustrated in FIG. 9. The protuberances or undercuts 22 and 24 formed along the upper edge of the recess 10 bear against the edge 46 of the retaining member and provide further surface to maintain the retaining member 28 in the recess 10. The opening 34 fits over the tab 26 extending upwardly from the bottom of the recess 10 to complete the force bearing members on the retaining member 28.

As best seen in FIG. 5, the display package 2 can be opened with the container member 4 displaying the package contents and with the flap 44 in the cover 6 providing a surface for advertising or similar copy.

I claim:

1. A display package comprising;

a container member provided with cavities contoured to accommodate the article being displayed;

a separate cover;

means in the form of a retaining member hingedly attached to the cover for attaching the cover to the container member;

a recess in the container member adapted to securely grip the retaining member of the cover;

overlapping edge members at each end of the recess in the container member;

depressions in the recess directly below each of the overlapping edge members;

intermediately disposed protuberances at the top of the recess in the container member;

a centrally disposed tab extending upwardly from the bottom of the display container recess; and wherein the retaining member is configured in the size and shape of the recess in the container member and is provided with inclined edges.

2. A display package as in claim 1 further comprising a finite hinge member extending the length of the retaining member attached to the cover.

3. A display package as in claim 2 wherein the finite hinge is formed by a first score line between the hinge and the retaining member and a second score line between the hinge and the edge of the back side of the cover.

* * * * *